United States Patent [19]

Poitras

[11] Patent Number: 4,830,369

[45] Date of Patent: May 16, 1989

[54] BASEBALL PITCHING PRACTICE TARGET

[76] Inventor: Léandre Poitras, 465 Seigneuriale Street, Beauport, Quebec, Canada, G1C 3R3

[21] Appl. No.: 99,789

[22] Filed: Sep. 22, 1987

[51] Int. Cl.[4] ..... A63B 69/40

[52] U.S. Cl. ..... 273/26 A; 273/376

[58] Field of Search ..... 273/29 A, 30, 26 A, 273/181 R, 181 B, 181 G, 181 H, 181 J, 181 K, 182 A, 317, 348, 378, 379, 381, 386, 387, 388, 396, 407, 410

[56] References Cited

U.S. PATENT DOCUMENTS

| | | | |
|---|---|---|---|
| 812,589 | 2/1906 | McNelly | 273/381 |
| 2,162,438 | 6/1939 | Letarte | 273/26 A |
| 2,954,232 | 9/1960 | Auer | 273/181 G |
| 3,133,733 | 5/1964 | Elseroad | 273/26 A |
| 3,288,467 | 11/1966 | Rudolph | 273/386 |
| 4,199,141 | 4/1980 | Garcia | 273/26 A |
| 4,390,181 | 6/1983 | Parish | 273/26 A |

*Primary Examiner*—Richard C. Pinkham
*Assistant Examiner*—T. Brown

[57] ABSTRACT

A baseball pitching practice device comprising a support frame to which is independently supported a plurality of panel members disposed side-by-side and forming a target area. Each of the panels has a designated segment portion of the target area. The target area includes a central strike zone area delimited by some of the panel members. One or more normally-open electrical contacts are associated with each of the panels and closable upon the application of an impact force on an outer surface of its associated panel. A display device is provided to identify which panel has been subjected to an impact force. A visual display identifies the panel having been impacted and also provides a numerical read-out of a total numerical value with each of the panels having independent numerical values.

10 Claims, 1 Drawing Sheet

BASEBALL PITCHING PRACTICE TARGET

BACKGROUND OF THE INVENTION

1. Field of the invention

The present invention relates to a baseball pitching practice device particularly, but not exclusively, for training the pitching skills of a baseball pitcher and wherein the skills of the person throwing balls at a target area are automatically indicated and displayed.

2. Description of Prior Art

Various types of target games or devices associated with the game of baseball are known. For example, such a device is described in U.S. Pat. No. 2,657,931 issued Nov. 3, 1983. However, such a device is not to improve the actual pitching skills of a person throwing balls at a target area, but merely constitutes a baseball game, which does not help the pitching skills of a person such as when confronted with a person at bat in a real game situation. In the referenced device, the ball hitting the target will hit specific parts of the target which simulates plays in a baseball game. It is mainly a game of hazzard rather than a training or practice device. Also, because of this small target area, the person throwing balls at the target area must stand relatively close to that target area and not the actual pitching distance as in the real game of baseball. Furthermore, the device cannot be classified as a portable game.

SUMMARY OF INVENTION

It is a feature of the present invention to provide a baseball pitching practice device which substantially overcomes the above-mentioned disadvantages of the prior art.

Another feature of the present invention is to provide a baseball pitching practice device which will help train a baseball pitcher and wherein the device has a target area which duplicates the strike zone area as in a real baseball game situation.

Another feature of the present invention is to provide a baseball pitching practice device which will provide an indication to the user as to which area of a total target area each thrown ball impacted and further which will provide an accumulated read-out count which is proportional to the skills of the person throwing balls at the target area.

Another feature of the present invention is to provide a baseball pitching practice device which is relatively inexpensive to construct and which may be used as a game, for a non-skill person, as well as a training or practice device for a skilled person.

According to the above features, from a broad aspect, the present invention provides a baseball pitching practice device comprising a support frame. A plurality of panel members are independently supported by the frame and side-by-side relationship to form a target area. Each of the panels has a designated segment portion of the target area. The target area also includes a central strike zone area which is delimited by some of the panel members. A normally-open electrical contact means is associated with each of the panels and closable upon applying an impact force on an outer surface of its associated panels. Display means is provided to identify which panel has been subjected to an impact force.

BRIEF DESCRIPTION OF DRAWINGS

A preferred embodiment of the present invention will now be described with reference to an example thereof as illustrated in the accompanying drawings, in which.

DESCRIPTION OF PREFERRED EMBODIMENTS

Figure 1:
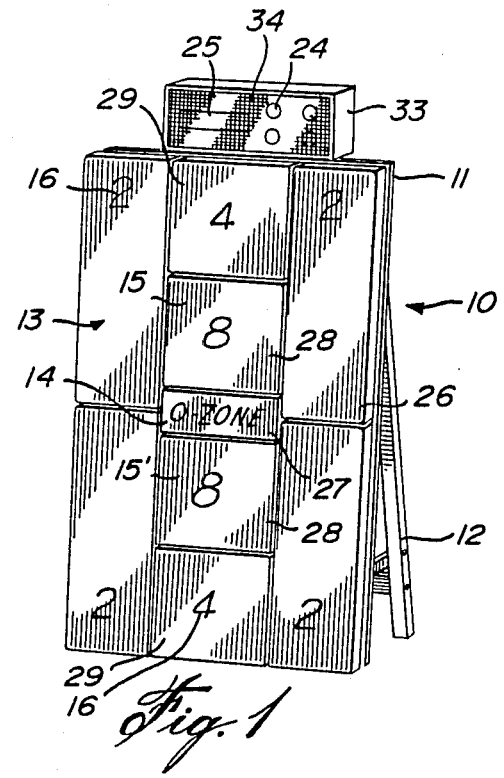
FIG. 1 is a perspective view of the baseball pitching practice device of the present invention.
Figure 2:
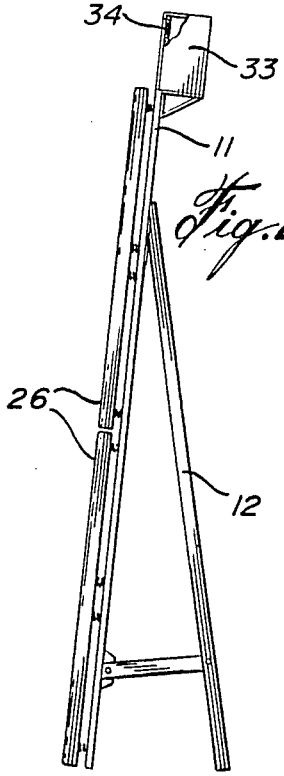
FIG. 2 is a side view of FIG. 1.

Referring to the drawings, more particularly to FIG. 1, there is shown generally at 10, the baseball pitching practice device of the present invention. The device comprises a support frame which consists essentially of a large rectangular solid rear wall 11 having pivotally connected support legs 12 to maintain the device in a substantially vertical or slightly rearward inclined plane, as shown in FIG. 2, when in use.

Figure 3:
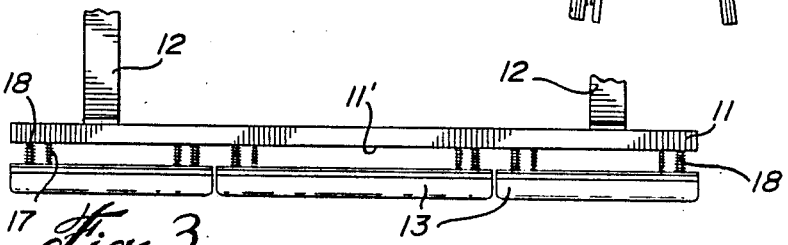
FIG. 3 is a top view, partly fragmented, of the baseball pitching practice device.
Figure 4:
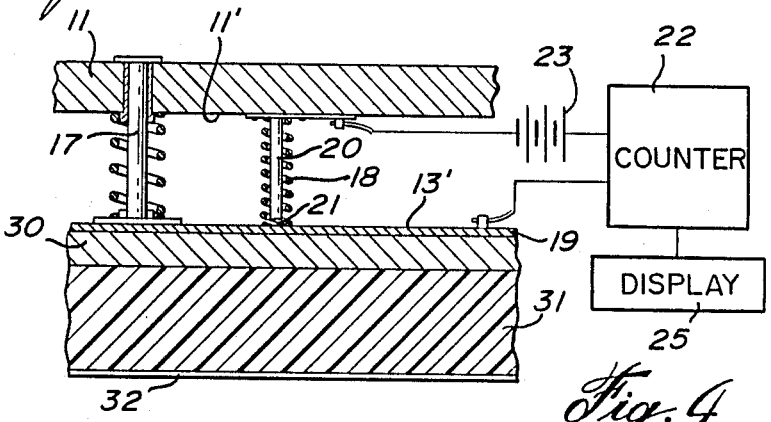
FIG. 4 is a fragmented enlarged section view showing the construction of the panel members and the support frame and the connection of the switches to a displayed device.

A plurality of panel members 13 are independently supported by the solid rear wall 11 of the frame in side-by-side relationship to form a large rectangular target area. Each of the panels 13 are of substantially rectangular square configuration and occupy a designated segment portion of the target area. The target area also includes a central strike zone area delimited by the panels 15 and 15', with a hit zone panel 14 situated therebetween. As herein shown each of the panel 13 are also provided with a numerical value or number 16, the purpose of which will be described later. Referring now additionally to FIGS. 2 to 4, it can be seen that each of the panels 13 is independently supported and spaced forwardly of the rear wall 11. Each of the panels 13 are supported in guided alignment with respect to the rear wall 11 by suitable means such as guide pins or rods 17 which extends into or through the rear wall 11 for guided displacement of the panel members with respect to their rear wall. A plurality of coil springs 17' are provided about the rods 17 between a front face 11' of the rear wall and a rear face 13' of each panel members to provide an outer biasing force of the panels.

As shown in FIG. 3, each panels is associated with two or more normally-open electrical contacts which are constituted by a first electrically conducted strip 19 secured to the rear surface 13' of each of the panels 13, and a second pin contact 20 secured to the rear wall and in alignment with the conductive strip 19. The spring force of the coil spring 18 provides biasing of these contacts in normally-open electrical condition, thereby leaving a gap 21 between the contact end of the contact pin 20 and the conductive strip 19. These two contact elements are connected to a counter device 22 and to a battery supply 23 whereby upon effecting a contact closure the counter will identify the particular switch closure and cause an indicating lamp 24, associated with a particular panel of which the first contact is closed, to light. Additionally, the counter will cause a visual display device 25 to display a numerical value associated with that panel, such as a value of 2, 4 or 8 to be displayed or added to the member on the display 25. The specific wiring of such a counter is obvious to a person skilled in the art and is therefore, not disclosed in detail herein.

It is also pointed out that the panel 13 also have different colors associated with the numerical values 16. For example, the outside vertical panels 26 may have the color RED, the narrow rectangular horizontally disposed panel 27 WHITE, the two large rectangular strike zone panels 28 GREEN and the additional large rectangular panels 29 YELLOW all the outside panels are "ball zone" panels. Accordingly, there are four different colors and each of which is associated with the like colored one of the four color lamps 24. These lamps 24 are secured in the housing 33 and protected by a metal screen 34. It is also pointed that if a ball is impacted in a region between two adjacent panels, that only one of the lamps 24 will light, and that being the lamp associated with the switch which first closes.

As can be seen, the narrow rectangular horizontally disposed panel 27 simulates a baseball bat and this zone is the "hit" zone and has a zero rating. It is located centrally in the strike zone and the pitcher should try not to strike. In order to improve the skills of a person in the pitching of baseball, the person usually stands at a fixed distance from the target area, usually 60 feet, which is the exact distance as utilized in the game of baseball and projects the ball towards the strike zone. The player will throw a pretermined number of balls and the object of the game is to strike the panels immediately above and below the narrow white panel 27. These are the higher score panels which accumulates higher points. Accordingly, a person can improve its pitching skills by keeping in mind the total count after a predetermined number of balls are thrown at the target area and that person must try to improve the total accumulated points of the previous practice session. It is also pointed that the device will indicate to the user exactly where the ball struck, as from a distance of 60 feet it is often difficult for the person throwing the ball to know precisely if he hit the strike zone or missed it to the right, left or above or below. In other words, the device will always provide an accurate indication where the ball struck and does a way with improper judgement calls.

As shown in FIG. 4, the rear panel 11 is constructed of a solid material such as wood or the like. Each of the panel 13 are constructed of a wooden backing board 30 to which is secured a hard foam core sheet 31. This sheet is also preferably covered with a vinyl, plastic or leather sheet 32 to protect the foam core 31. The spacing between the surfaces 11' of the back wall and the rear surface 13' of the panels is about of one inch with the switch contact gap being about 1/16 of an inch. The housing 33 containing the display 25 and the lamps 24 as well as the counter 22, is detachably secured to the top edge of the rear wall 11 to facilitate the portability of the device. A 12-volt battery 23 is all that is necessary for the operation of the electrical circuit and for the simplicity of illustration, the battery, as shown in FIG. 4, is only shown connected to one of the contacts, although, all the panels have four contacts associated therewith. It is within the ambit of the present invention, to cover any obvious modifications of the examples of the preferred embodiments described therein, provided such modifications fall within the scope of the appended claims.

I claim:

1. A baseball pitching practice device comprising a support frame, a plurality of panel members independently supported by said frame in side-by-side relationship to form a target area, each said panel constituting a segment portion of said target area, said target area including a central strike zone area delimited by some of said panel members, a normally-open electrical contact means associated with each said panel and closable upon applying an impact face on an outer surface of its associated panel, display means to identify which panel has been subjected to an impact force, said target area further including a hit zone defined by a narrow rectangular horizontally disposed panel located centrally of said target area with a large rectangular strike zone panel supported along each elongated straight edge above and below said narrow rectangular horizontally disposed panel, said large rectangular panels each having a like numerical value which is added and accumulated by counter means associated with said display means, an additional large rectangular panel is supported along an outer straight edge of each said strike zone panel, said additional panels having a like numerical value which is less than the numerical value of said strike zone panels and being ball zone panels; two elongated rectangular panels are vertically supported end to end and disposed along opposed straight end edges of said narrow rectangular horizontally disposed panel, said strike zone panels and said additional large rectangular panels; said elongated rectangular panels which are vertically supported having a like numerical value which is less than the numerical value of said additional panels and being ball zone panels.

2. A practice device as claimed in claim 1 wherein there is further provided counter means to accumulate and add numbers associated with individual ones of said panels, and display means to provide a visual display of said added numbers.

3. A practice device as claimed in claim 2, wherein each said panel is provided with a resistant outer surface covering.

4. A practice device as claimed in claim 2, wherein said panels are resiliently secured to said support frame and displaceable upon being subjected to said impact force, said normally-open electrical contact means having a first contact fixed to each said panels and a second contact aligned with said first contact and spaced rearwardly therefrom, said panel being displaced rearwardly upon being subjected to said impact force to cause said first and second contacts to touch one another thereby sending a signal to said counter means to identify which of said panels has been subjected to an impact force.

5. A practice device as claimed in claim 4 wherein said counter means is contained in a display housing constituting said display means, said display housing having a numerical display window to display said added numbers.

6. A practice device as claimed in claim 5 wherein said display housing is further provided with a plurality of lamps which are associated with one or more of said panels in accordance with said differing number values.

7. A practice device as claimed in claim 6, wherein said panels are of different colors, said panels with like number values being of the same color, said lamps being of the same color as their associated panels and being lit by the closure of any of said normally-open electrical contacts of its associated panels.

8. A practice device as claimed in claim 7, wherein each said panels is provided with at least two of said normally-open electrical contact means.

9. A practice device as claimed in claim 1, wherein a ball projectile is directed to said target area to effectuate said impact force, said narrow rectangular horizontally disposed panel having no numerical value.

10. A practice device as claimed in claim 1, wherein there is further provided spring biased support means to support said panel members spaced forwardly of said support frame.

* * * * *